United States Patent [19]

O'Connell et al.

[11] Patent Number: 4,623,448

[45] Date of Patent: Nov. 18, 1986

[54] REMOVING HALOGENATED POLYPHENYL MATERIALS FROM USED OIL PRODUCTS

[75] Inventors: John P. O'Connell, Oakbrook; John F. Wozniak, Orland Park, both of Ill.

[73] Assignee: Moreco Energy, Inc., McCook, Ill.

[21] Appl. No.: 710,843

[22] Filed: Mar. 12, 1985

[51] Int. Cl.[4] ..... C10G 17/00

[52] U.S. Cl. ..... 208/262; 196/46; 208/179; 208/181; 208/182; 585/469

[58] Field of Search ..... 208/179, 181, 182, 262; 585/469; 196/46

[56] References Cited

U.S. PATENT DOCUMENTS 4,101,414 5/1985 Kim et al. ..... 208/18

4,351,978 9/1982 Hatano et al. ..... 208/262

OTHER PUBLICATIONS

Chemical Abstracts, 81, 104963e.

Chemical Abstracts, 89, 101844w.

Hydrocarbon Processing, "1980 Refining Handbook Issue", vol. 59, No. 9, Sep. 1980.

*Primary Examiner*—Curtis R. Davis

*Attorney, Agent, or Firm*—Lockwood, Alex, Fitzgibbon & Cummings

[57] ABSTRACT

A method and an apparatus are provided for removing halogenated polyphenyl materials from used or waste oil supplies. Waste or used lube stock is subjected to rerefining procedures in order to remove many of the impurities found in such waste or used stocks. The rerefined stock which is contaminated with halogenated polyphenyls is continuously pumped under pressure and mixed with highly pressurized hydrogen gas which is heated to a relatively low temperature and passed through a bed of catalyst in order to promote a reaction that forms a hydrogen halide and a polynuclear aromatic material that does not exhibit the environmental and health hazards of a halogenated polyphenyl material such as PCB's.

20 Claims, 2 Drawing Figures

REMOVING HALOGENATED POLYPHENYL MATERIALS FROM USED OIL PRODUCTS

BACKGROUND AND DESCRIPTION OF THE INVENTION

The present invention generally relates to an apparatus and method for removing halogenated polyphenyl materials from used oil products, more particularly to an apparatus and method that removes polychlorinated biphenyls (known as PCB's) and like contaminants from used oil materials, typically in conjunction with the so-called rerefining of used lubricating oil stocks, which includes removal of impurities from such used stocks. Removal of the halogenated polyphenyl materials includes treating flowing used oil stock with pressurized hydrogen gas in the presence of a catalyst whereby the halogenated polyphenyl material is dehalogenated to form a hydrogen halide, which may be properly treated or disposed of, and polynuclear aromatic material which does not have the undesirable attributes that have come to be associated with halogenated polyphenyl materials such as polychlorinated biphenyls.

Halogenated polyphenyls such as polychlorinated biphenyls, polychlorinated triphenyls and polybrominated biphenyls had been widely used as industrial chemicals for a wide variety of uses. One of the attributes of such compounds is that they are highly stable. This has, in the long run, also proven to be a serious disadvantage because of what has come to be appreciated as the long-term deleterious environmental and health effects of these compounds which persist in various arenas including those that find their way into waste oil dumps and into used oil sources of the type that can be recycled, provided such recycling includes measure to substantially completely remove the halogenated polyphenyls therefrom. This task is a difficult one, due in part to the extremely high stability of these compounds and due also to the fact that current environmental and health standards require removal of all but substantially undetectable amounts of these types of compounds before the used oil with which they are contaminated can meet environmental and health standards.

Attempts have been made to destroy polyhalogenated polyphenyls within waste or used oil supplies. One such approach is incineration. By this approach potentially valuable oil as well as the polyhalogenated polyphenyls are destroyed. At best, only the heat of incineration is recovered. Besides being wasteful of petroleum resources, this approach requires a relatively high incineration temperature and extensive residence time because of the inherent stability of the polyhalogenated polyphenyls, this procedure requiring a substantial capital investment in an incinerator apparatus that is capable of developing the rather severe conditions needed to destroy the polyhalogenated polyphenyls.

Another approach that has been taken in an attempt to remove polyhalogenated polyphenyl contamination from waste or used oil resources is a procedure which includes mixing liquid sodium, sometimes in association with an alcohol, under conditions which promote a reaction between the halogen groups of the polyphenyl and sodium in order to form sodium salts such as sodium chloride, while dehalogenating the polyhalogenated polyphenyl material into polynuclear aromatic materials which do not pose the environmental and health hazards that are associated with polyhalogenated polyphenyls. Generally speaking, the liquid sodium approach is an extremely expensive procedure which may not be economically justified.

It has been determined that hydrogenation systems are suitable for proceeding with dehalogenation of polyhalogenated polyphenyls into polynuclear aromatic material and a hydrogen halide such as hydrogen chloride. If hydrogenation procedures are carried out generally in accordance with this invention, such are substantially less expensive than the liquid sodium procedures, typically on the order of one-half of the cost, and while requiring a capital expenditure that is less than that of a comparably sized incineration unit for used or waste oils.

So-called rerefining techniques for recycling used or waste oils have been improved in effectiveness and efficiency in the last several years. One such advantageous system is that of U.S. Pat. No. 4,101,414, the disclosure of which is incorporated by reference hereinto. This system combines steam stripping or predistilling of a used oil stock with subsequent vacuum distilling the predistilled stock. Such a system advantageously removes many undesirable contaminants other than polyhalogenated polyphenyls from the oil stock.

It is accordingly a general object of the present invention to provide an improved method and apparatus for continuously and efficiently removing polyhalogenated polyphenyls from used or waste oil.

Another object of the present invention is to provide an improved apparatus and method for removing impurities such as heavy metals, other metals, polyhalogenated polyphenyls, oxides, naphthenates, light oil components, and water from supplies of used or waste oil.

Another object of this invention is to provide an improved apparatus and method for rerefining used lubricating oil stocks, transformer oils and the like, including removing polyhalogenated polyphenyls in an inexpensive and effective manner.

Another object of the present invention is to provide an improved apparatus and method which is suitable for using as a unit located downstream of a used oil treatment system, which unit is especially designed to substantially completely remove polyhalogenated polyphenyls from the used oil stock.

These and other objects, features and advantages of this invention will be clearly understood through a consideration of the following detailed description.

DESCRIPTION OF THE PARTICULAR EMBODIMENTS

Figure 1:
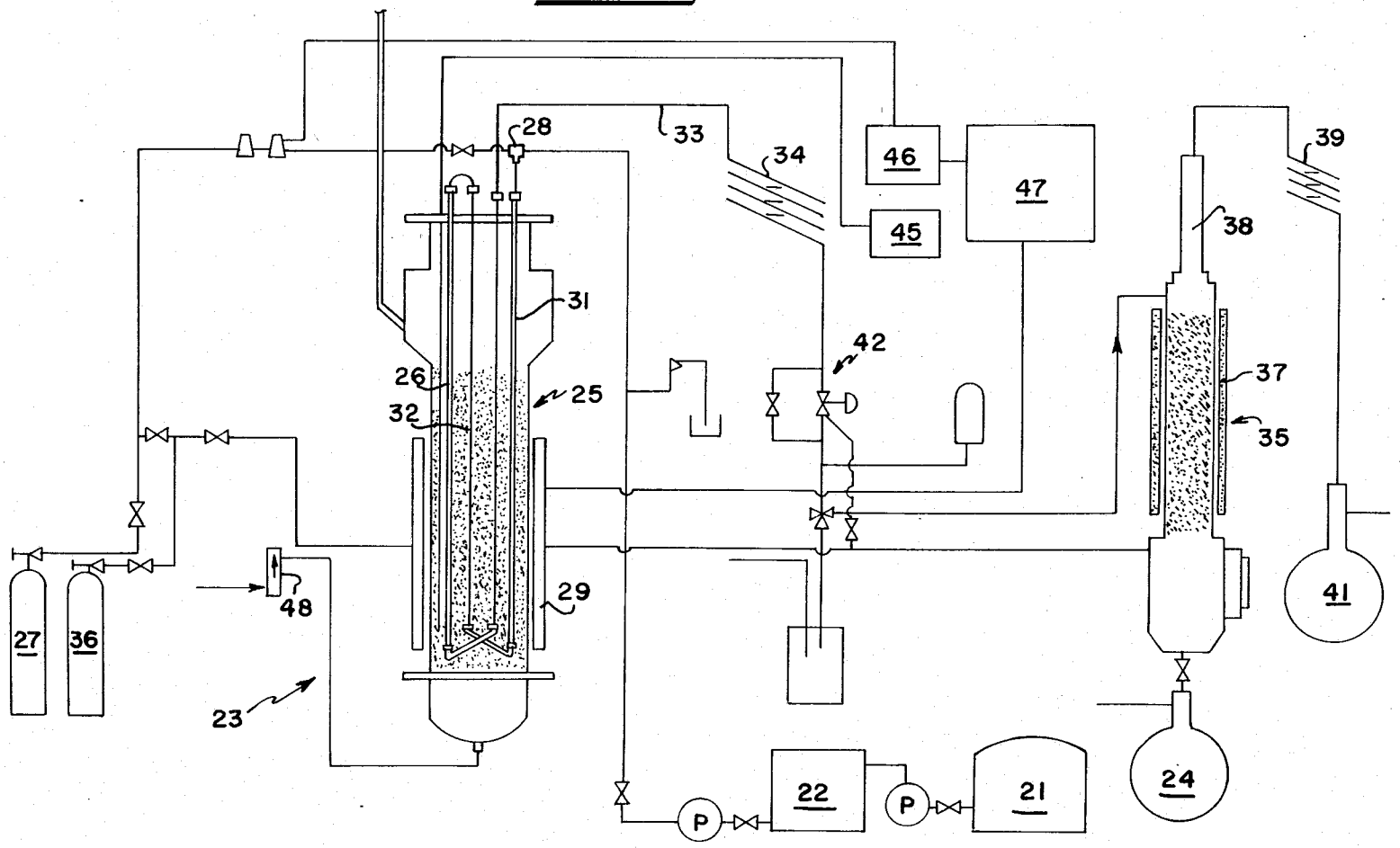
FIG. 1 is a generally schematic view of a system in accordance with this invention that substantially completely removes polyhalogenated polyphenyl compounds from used oil stock or waste oil sources.

With particular reference to FIG. 1, a used oil source 21, such as a tank or bin of used lubricating oil or some other supply of waste oil is suitably connected to and is upstream of a rerefining assembly, generally designated as 22, which is upstream of and in fluid flowing communication with a hydrogenation assembly, generally designated as 23. Rerefined oil from which polyhalogenated polyphenyl compounds have been removed, is collected in a product reservoir 24.

Hydrogenation assembly 23 includes a reactor subassembly, generally designated as 25, which includes a reaction chamber 26, within which polyhalogenated polyphenyls within the used oil stock are dehalogenated into polynuclear aromatic material and hydrogen halide. Pressurized hydrogen gas is flowed into and through the reaction chamber 26 from a hydrogen gas source 27. Preferably, used oil from the rerefining assembly 22 and hydrogen gas from the source 27 flow together through the reaction chamber 26, such being in conjunction with the continuous removal of polyhalogenated polyphenyls in accordance with this invention, this combined or mixed flow typically being facilitated by a suitable feed inlet 28 which facilitates the entry of pressurized hydrogen gas into the oil flow.

Reactor subassembly 25 further includes a heating unit 29 for raising the temperature of the oil stock prior to its entry within the reaction chamber 26. This oil stock is advantageously heated prior to its flow into the reaction chamber 26, as illustrated. Also preferably included within the reactor subassembly 25 is a guard reactor 31 for removing any possible contaminants which might remain within the used oil stock and which would foul or otherwise damage catalyst materials that are within the reaction chamber 26. For example, guard reactor 31 may include acid activated clay pellets for absorbing any residual heavy metals that might remain within the used oil stock at this location within the overall system. A return conduit 32 joins the outlet end of the guard reactor 31 with the inlet end of the reaction chamber 26.

Flowing out of the reaction chamber 26 and through outlet conduit 33 is a mixture including rerefined and decontaminated oil, hydrogen halide, hydrogen gas, polynuclear aromatic compound, and water. This flow may be passed through a cooling column 34 for passage to a fractionation tower or stripping column, generally designated as 35 by which residual light fractions are removed from the decontaminated oil flowing from the reactor subassembly 25, typically in association with nitrogen gas from a nitrogen gas source 36. The rerefined and decontaminated product flowing from the stripping column 35 into the product reservoir 24 includes rerefined oil and polynuclear aromatic material such as biphenyls that are reactants from the polyhalogenated polyphenyls in the waste or used oil stock from the supply 21.

Stripping column 35 includes heating elements 37 and a collector 38 through which low boiling components are removed, such components including hydrogen halide gas, water, and light hydrocarbons that are vaporized at the elevated temperature of the stripping column 35. After passing through a condenser 39, these components are collected in chamber 41 for subsequent scrubbing, incineration or the like. A back pressure controller assembly 42 is preferably located between the reactor subassembly 25 and the stripping column 35. Back pressure controlling assembly 42 assists in maintaining the desired amount of pressure within the reactor subassembly 25.

If desired, a high pressure flash tank 43 (FIG. 2) may be included upstream of the stripping column 35 in order to recover excess hydrogen gas which may be returned to the feed line, for example, at the feed inlet 28. Also, in order to recover some of the heat generated by the heating unit 29, a heat exchanger 44 may be positioned upstream of the heating unit 29 such that heated stock from the reaction chamber 26 will be in heat exchange communication with rerefined stock that is incoming to the hydrogenation assembly 23 in order to thereby preheat the stock prior to its passage into the heating unit 29.

Also typically included within the hydrogenation assembly are components such as a temperature probe 45 to monitor the temperature within the reactor subassembly 25, a hydrogen gas feed control unit 46, a unit 47 for controlling the heaters and the feed pumps, and an air inlet regulator 48.

Figure 2:
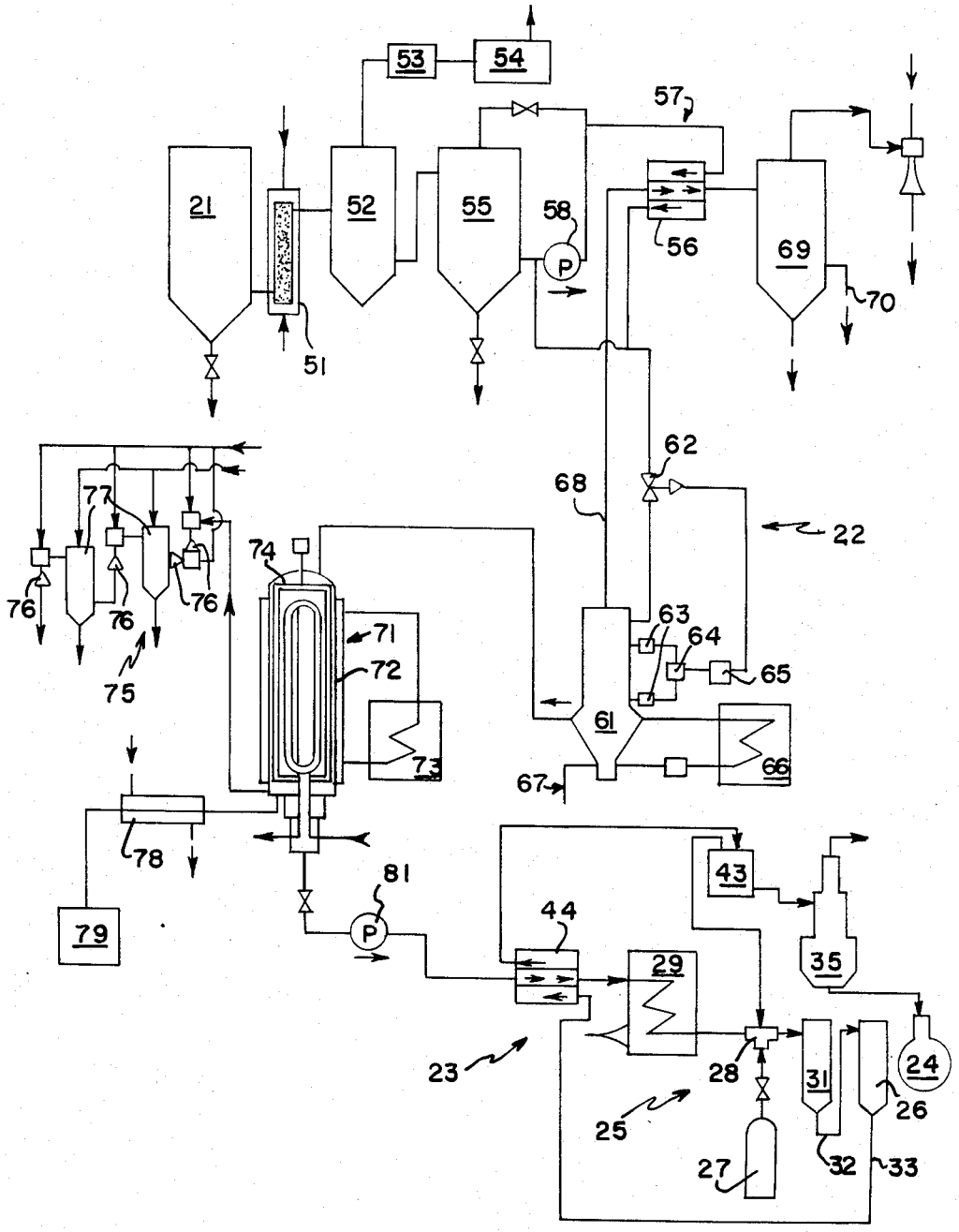
FIG. 2 is a generally schematic view of a system in accordance with this invention, showing further details of components for steam stripping and vacuum distilling the used oil stock or waste oil supply prior to its treatment for the removal of polyhalogenated polyphenyls therefrom.

With more particular reference to the rerefining assembly 22, especially advantageous results are achieved for certain used oils if the rerefining assembly 22 is capable of removing from the used oil supply 21 substantially all of the $NO_x$ gases, sulfur values, and a substantial extent of the heavy metals and other metals that may be present within the used or waste oil stock. A preferred rerefining assembly 22 is illustrated in FIG. 2. Used oil from the supply tank 21 is heated by a suitable heater 51 and passed through a flash tank 52 by which relatively volatile gases are removed from the stock for passage to a water scrubber 53 and/or incinerator 54. The thus devolatilized oil stock then proceeds from the flash tank 52 into a feed tank 55, from which the oil stock is pumped to a heat exchanger 56, preferably by way of a recirculation conduit assembly, generally designated by reference numeral 57, which effects recirculation of overflow stock between the feed tank 55, its pump 58, and the heat exchanger 56.

A distillation still 61 receives oil stock from the heat exchanger 56, preferably in association with a pneumatic control valve assembly 62 which is associated with pressure level sensors 63, a differential pressure transmitter 64 and a pneumatic activating cell 65, by which the valve assembly 62 regulates the amount of oil stock that flows into the still 61.

Distillation still 61 includes a furnace 66 that heats the oil stock flowing through the distillation still 61 in accordance with generally known procedures. Preferably, the distillation still 61 includes a steam stripping assembly 67 which passes steam at an initial pressure of on the order of 15 to 50 psig up through the heated oil within the distillation still 61, resulting in the separation of light oil vapors, which are drawn off along with excess stripping steam from the top of the distillation still 61 and out of same through a conduit 68. Conduit 68 directs the light oil vapor and steam vapor to a separator unit 69, preferably while passing through the heat exchanger 56 in order to assist in preheating the oil stock before it enters the distillation still 61. Light oil driven off in the distillation still 61 can thus be separated from water and steam, the light oil exiting from the separator unit 69 through an outlet 70.

The distillation still 61 forms a predistilled stock by removing undesirable contaminants such as $NO_x$ gases, light oil, and residual water from the used or waste oil stock in order to prepare same for vacuum distillation within a vacuum evaporator, generally designated as 71, which is preferably of the "wiped film" type. Evaporator 71 should be of a type that is capable of distilling a oil stock under high vacuum conditions and below the cracking temperature of the stock. A preferred evaporator 71 includes a vertical cylindrical wall 72 that is heated by the condensing of a vaporous heating medium such a "Dowtherm A," which is continually heated during its flow through a boiler 73. In the preferred structure, the vertical cylindrical wall 72 is constantly wiped by a rotating blade assembly 74. The vacuum or low pressure condition within the evaporator 71 is supplied by a structure that is capable of generating extremely low pressure conditions, on the order of 0.1 to 2 mmHg of pressure, by virtue of which superior separation of impurities from the predistilled stock can be accomplished even at a somewhat moderate, sub-cracking temperature of between about 250° and 350° C. Suitable pressure conditions can be generated with respect to the predistilled stock by a steam ejector system, generally designated at 75. A suitable low pressure generator includes a four-stage, steam-jet ejector system that operates a vacuum pump, such including steam eductors 76 and two internal barometric condensors 77.

Impurities removed from the predistilled stock by the vacuum evaporator 71 may pass through a condenser 78 for cooling before passage to a storage tank 79 or the like. The predistilled and vacuum evaporated rerefined used oil stock exits from the vacuum evaporator 71 for passage through a pump 81 and to the hydrogenation assembly 23.

Within the preferred rerefining assembly 22, the used lubricating oil stock is predistilled, preferably by being steam stripped for several hours, at a temperature below its cracking temperature to remove light components therefrom. The predistilled stock is then vacuum evaporated at a temperature below the cracking temperature of the stock, the preferred vacuum evaporation including forming a thin film of the predistilled stock upon a heated surface that is within a very low pressure environment, constantly wiping this surface to maintain a thin film of the stock, and separating the stock into a lubricating oil fraction and a fraction including viscous heavy lube hydrocarbons, additives and other high boiling point components. This separation takes advantage of the fact that the lubricating oil within the stock that is being rerefined evaporates on the heated surface, while the heavier components do not evaporate under these conditions, this procedure resulting in the formation of a superior rerefined oil product, which when subjected to the conditions and treatment procedures of the hydrogenation assembly 23, results in especially efficient and effective removal of polyhalogenated polyphenyls that are within the stock and that are not removed by the treatment conditions and procedures of the rerefining assembly 22.

Predistillation, in order to be effective in removing the lower boiling materials from the waste or used oil stock, should proceed for a length of time that is substantially in excess of that provided by a flash distillation procedure. While the length of time for predistillation can be so extensive as to be carried out for up to or at least about four hours, the length of time needed for any particular stock will depend upon the makeup of the particular waste or used oil stock being rerefined and decontaminated. It will be appreciated that, since the stock is essentially a waste material, the composition of such stocks can vary greatly. Predistillation can be carried out for as long as eight hours or more as needed. It is important that the stock be maintained below its cracking temperature during predistillation as well as during all phases of treatment carried out within the rerefining assembly 22 and within the hydrogenation assembly 23.

Within the hydrogenation assembly 23, the rerefined stock flows through the reaction chamber 26 at a rate such that the amount flowing through the catalyst bed each hour is approximately equal to about one-half of the liquid volume of the catalyst bed. In association therewith, the hydrogen gas entering the reactor subassembly 25 for reaction with polyhalogenated polyphenyls within the reaction chamber 26 is at a relatively low volume rate of not much greater than about 150, typically on the order of 100, standard cubic feet of hydrogen gas per barrel of oil stock, which is on the order of roughly 1 to 2 moles of hydrogen gas per 10 moles of oil stock, typically about 0.3 mole of hydrogen gas per 2 moles of oil stock treated within the reaction chamber 26. This is at a hydrogen gas pressure of on the order of approximately 650 to 750 psi, typically about 700 psi, such being the approximate pressure at which the oil stock and the hydrogen gas are passed through the system. By proceeding with the use of this somewhat high pressure, it is possible to operate at a somewhat lower temperature, provided the standard cubic feet of hydrogen gas per barrel remains generally at these levels. By the present system, it is possible to operate the hydrogenation unit at an unusually low temperature, for example on the order of between 260° and 290° C., or 500° to 550° F., which minimizes a problem often associated with contacting oil with catalyst beds, such problem being that of the development of coking onto the catalyst resin beads and the like. With this feature, it is possible to run the reactor subassembly 25 for on the order six months before having to replace the catalyst bed.

Use of hydrogen gas in this manner within the hydrogenation assembly 23 minimizes the use of hydrogen gas and substantially eliminates the need to provide hydrogen gas at greater than stoichiometric amounts. For example, in typical hydrogenation procedures, on the order of 1000 standard cubic feet of hydrogen gas are required per barrel of oil, rather than the approximately 100 standard cubic feet of hydrogen gas per barrel of oil that is expended by this invention. This relatively low level of use of hydrogen gas when compared with other hydrogenation systems is positively affected by providing a used stock that is predistilled by superior procedures such as those carried out by the preferred rerefining assembly 22. Particularly important in this regard is minimizing the presence of sulfur and $NO_x$ values in the oil stock that enters the reactor subassembly 25. Also important is that the catalyst have an appropriate average pore size and the like, as well as provide the needed chemical impetus for the reaction between the hydrogen gas and the polyhalogen polyphenyl contaminant. It has been found that nickel/molybdenum catalysts are especially suitable in this regard. Ketjen nickel/molybdenum catalysts of Armak, Catalycal nickel/molybdenum catalysts, Catalco catalysts, Phillips catalysts, and Filtrol-activated Guard pellets can be used within the reaction chamber 26.

Inasmuch as, for substantially all hydrogenation catalysts, such a nickel-molybdenum catalyst bed can be seriously damaged by low concentration levels of heavy metals and the like which can foul the catalyst bed, the guard reactor 31 is preferably included in order to contact the stock with a material that absorbs such residual fouling materials. Suitable guard reactor materials include activated clays.

The following Examples are set forth as illustrative embodiments of this invention and are not to be taken in any manner as limiting the scope of the invention which defined by the appended claims.

EXAMPLE I

Used oil stock was collected after having been passed through a rerefining assembly such as that illustrated in FIG. 2. To this collection, a total of 50 ppm of polychlorinated biphenyls (PCB's) were added in order to form a contaminated, rerefined oil stock. This contaminated oil stock was continuously pumped under pressure and mixed with hydrogen gas at a pressure of 700 psig, the oil and hygroden gas flows being controlled in order to achieve a mixed ratio of 150 standard cubic feet of hydrogen per barrel of oil stock. The hydrogen and oil mixture was then heated to a temperature of 425° F. and passed through a bed of clay pellets to absorb catalyst-contaminating heavy metals, after which the mixture was passed through a bed of nickel-molybdenum catalyst. The effluent from the catalyst bed was cooled to near ambient temperature and then proceeded to a heated stripping column where the decontaminated stock was stripped with nitrogen gas to remove light by-products. The finished rerefined and decontaminated oil product was cooled and collected from the bottom of the stripper and tested for contamination. No detectable levels of polychlorinated biphenyls were found in the product, indicating that the concentration of polychlorinated biphenyls after decontamination according to this invention was less than 1 ppm.

EXAMPLE II

The procedure of Example I was substantially repeated, except 100 ppm of polychlorinated biphenyls were added. The final result was the same, in that no polychlorinated biphenyls were detected in the rerefined and decontaminated product, indicating a polychlorinated biphenyl concentration of less than 1 ppm.

EXAMPLE III

Automotive crankcase drainings generally of the SAE stock 20 grade were predistilled and vacuum distilled within a system substantially along the lines of the rerefining assembly shown in FIG. 2. 1000 ppm of polychlorinated biphenyls were added to form a contaminated, rerefined stock. Multiple runs were made through the hydrogenation assembly generally illustrated in FIG. 1, after which the decontaminated stock was subjected to infrared analysis, by which no polychlorinated biphenyls could be detected.

It will be understood that the embodiments of the present invention which have described are illustrative of some of the applications of the principles of the present invention. Numerous modifications may be made by those skilled in the art without departing from the true spirit and scope of the invention.

We claim:

1. A process for removing polyhalogenated polyphenyl materials from used oil supplies, comprising:

flowing a supply of used oil stock that has been rerefined and that is contaminated with halogenated polyphenyl materials;

blending said flowing supply of rerefined and contaminated used oil stock with a source of hydrogen gas that is at a pressure greater than atmospheric pressure in order to form a flowing blend of hydrogen gas and used oil stock;

moving said flowing blend of hydrogen gas and used oil stock through a guard reactor including a material for absorbing catalyst-fouling impurities from the flowing used oil stock, said moving step being prior to a step of passing the flowing blend of hydrogen gas and used oil stock through a catalyst bed; and passing said flowing blend of hydrogen gas and used oil stock through the catalyst bed in order to promote a chemical reaction that dehalogenates said halogenated polyphenyl material within said used oil stock into reaction products including a hydrogen halide and polynuclear aromatic material.

2. The process according to claim 1, wherein said supply of rerefined used oil is formed by subjecting a used oil stock to procedures which remove $NO_x$ gases, light oil components, sulfur components, residual water, metals, and heavy lube components from the used oil stock.

3. The process according to claim 1, further including heating said flowing blend of hydrogen gas and used oil stock prior to said step of passing said blend through the catalyst bed, said heating step raising the temperature of the blend to up to and not substantially higher than 260° to 290° C.

4. The process according to claim 1, further including, after said step of passing said blend through the catalyst bed, a stripping step by which outflow from the catalyst bed is separated into one flow of rerefined oil and polynuclear aromatic material and another flow including light hydrocarbons and hydrogen halide.

5. The process according to claim 1, wherein said stripping step includes contacting said catalyst bed outflow with nitrogen gas.

6. The process according to claim 1, wherein said step of passing the blend through the catalyst bed is carried out at a rate such that the volume of blend flowing therethrough per hour is approximately equal to about one-half of the volume of or more of the catalyst bed.

7. The process according to claim 1, wherein said step of blending said supply of hydrogen gas requires not much greater than about 150 standard cubic feet of hydrogen gas per barrel of oil stock.

8. The process according to claim 1, wherein said blending step combines between about 1 and about 2 moles of hydrogen gas per 10 moles of oil stock.

9. The process according to claim 1, wherein said blending step is a treating step that is conducted at a temperature of about 260° to 290° C., a hydrogen gas pressure of approximately 650 to 750 psi, and at a hydrogen gas flow rate of on the order of not much greater than 150 standard cubic feet of hydrogen gas per barrel of oil stock.

10. The process according to claim 1, wherein said catalyst bed includes a nickel/molybdenum catalyst.

11. A process for removing halogenated polyphenyl materials from used oil products, comprising:

steam stripping a supply of used oil stock that is contaminated with halogenated polyphenyl materials in order to form a steam stripped used oil stock;

vacuum distilling said steam stripped used oil stock to form a vacuum distilled rerefined stock having halogenated polyphenyl materials; and blending said vacuum distilled rerefined stock with a source of hydrogen gas, moving the blend of vacuum distilled rerefined stock and hydrogen gas through a material for absorbing catalyst-fouling impurities from the vacuum distilled rerefined stock, and thereafter contacting the blend of stock and hydrogen gas with a catalyst in order to effect a chemical reaction to dehalogenate said halogenated polyphenyl material within the vacuum distilled rerefined stock into reaction products including a hydrogen halide and polynuclear aromatic material.

12. The removing process according to claim 11, wherein said steam stripping step removes $NO_x$ gasses, light oil, and water from the used oil stock, said steam stripping step being carried out for a length of time substantially greater than that of a flash distillation procedure.

13. The removing process according to claim 11, wherein said steam stripping step is carried out for up to about four hours or more.

14. The removing process according to claim 11, wherein all of said steps are carried out at a temperature that is less than the cracking temperature of the used oil stock.

15. The removing process according to claim 11, wherein said vacuum distilling step includes wiping said steam stripped used oil stock to form a thin film thereof.

16. The removing process according to claim 11, wherein said vacuum distilling step is conducted at a pressure between about 0.1 to 2 mmHg.

17. The removing process according to claim 11, wherein said vacuum distilling step is conducted at a temperature between about 250° and 350° C.

18. An apparatus for removing halogenated polyphenyl materials from used oil products, comprising:

means for flowing a supply of rerefined used oil stock that is contaminated with halogenated polyphenyl material;

means for injecting pressurized hydrogen gas into the flow of rerefined and contaminated oil stock and for flowing the resultant hydrogen gas and oil stock blend under pressure;

a reactor assembly downstream of said injecting means, said reactor assembly including a guard reactor and a catalyst bed, said guard reactor having a material for absorbing catalyst-fouling materials from the flowing used oil stock, said guard reactor being upstream of said catalyst bed of material that promotes reaction between the hydrogen gas and the halogenated polyphenyl materials within the used oil stock; and a stripping column downstream of said reactor assembly, said stripping column being capable of removing volatile components from the decontaminated used oil stock.

19. The apparatus according to claim 18, further including, upstream of said rerefined stock flowing means, rerefining means including a distillation still upstream of a vacuum evaporator.

20. The apparatus according to claim 19, wherein said vacuum evaporator is a wiped film, very low pressure evaporator.

* * * * *

UNITED STATES PATENT AND TRADEMARK OFFICE

CERTIFICATE OF CORRECTION

PATENT NO. : 4,623,448

DATED : November 18, 1986

INVENTOR(S) : John P. O'Connell and John F. Wozniak

It is certified that error appears in the above-identified patent and that said Letters Patent is hereby corrected as shown below:

Col. 1, line 36, "measure" should read --measures--.
Col. 4, line 65, "a" should read --an--.
Col. 7, line 1, insert --is-- after "which"; line 12, "hygroden" should read --hydrogen--.
Col. 8. line 37, insert --or more-- before "of" (first occurrence) and delete "or more of" after "of" (second occurrence).

Signed and Sealed this

Twenty-second Day of September, 1987

*Attest:*

DONALD J. QUIGG

*Attesting Officer* *Commissioner of Patents and Trademarks*